US010403973B2

(12) United States Patent
Chen

(10) Patent No.: US 10,403,973 B2
(45) Date of Patent: Sep. 3, 2019

(54) EBG DESIGNS FOR MITIGATING RADIO FREQUENCY INTERFERENCE

(71) Applicant: Intel Corporation, Santa Clara, CA (US)

(72) Inventor: Chung-Hao Chen, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 153 days.

(21) Appl. No.: 14/258,683

(22) Filed: Apr. 22, 2014

(65) Prior Publication Data

US 2015/0303562 A1 Oct. 22, 2015

(51) Int. Cl.

| | |
|---|---|
| ***H01Q 15/02*** | (2006.01) |
| ***H01Q 1/52*** | (2006.01) |
| ***H01Q 1/24*** | (2006.01) |
| ***H01Q 15/00*** | (2006.01) |

(52) U.S. Cl.

CPC ..... *H01Q 1/526* (2013.01); *H01Q 1/242* (2013.01); *H01Q 1/52* (2013.01); *H01Q 15/008* (2013.01)

(58) Field of Classification Search

CPC ..... H01Q 1/526; H01L 23/3677
USPC ..... 343/842; 174/382; 361/719, 818
See application file for complete search history.

(56) References Cited

U.S. PATENT DOCUMENTS

| | | | | |
|---|---|---|---|---|
| 4,924,080 | A * | 5/1990 | Caserta | H01J 29/867 250/214 VT |
| 6,512,494 | B1 * | 1/2003 | Diaz | H01Q 7/00 343/842 |
| 7,848,108 | B1 * | 12/2010 | Archambeault | H01L 23/3677 165/185 |
| 8,013,258 | B2 * | 9/2011 | Wu | H01Q 1/526 174/382 |
| 8,434,220 | B2 * | 5/2013 | Rao | H01L 23/552 29/831 |
| 8,780,584 | B2 * | 7/2014 | Kim | H05K 1/0236 172/376 |
| 2003/0011522 | A1 * | 1/2003 | McKinzie, III | H01Q 1/52 343/700 MS |
| 2005/0029632 | A1 * | 2/2005 | McKinzie, III | H01P 1/16 257/665 |
| 2005/0104678 | A1 * | 5/2005 | Shahparnia | H05K 1/0216 333/12 |

(Continued)

FOREIGN PATENT DOCUMENTS

| | | | | |
|---|---|---|---|---|
| CN | 101996963 | A | 3/2011 | |
| EP | 1863114 | A1 * | 12/2007 | H01P 1/08 |

OTHER PUBLICATIONS

CN Search Report, CN Application No. 201510123368.1, search report dated Jun. 22, 2017, 2 pages.

*Primary Examiner* — Dieu Hein T Duong
*Assistant Examiner* — Bamidele A Jegede
(74) *Attorney, Agent, or Firm* — International IP Law Group, P.L.L.C.

(57) ABSTRACT

An apparatus for electromagnetic interference shielding is described herein. The apparatus includes an electromagnetic bandgap (EBG) structure. The EBG structure is attached to a surface of the apparatus such that noise propagation is mitigated. The apparatus may be a chassis of an electronic device, and the EBG structure may be attached to one surface of the chassis. Further, the apparatus may be a heat sink, and the EBG structure can be attached to one surface of the heat sink.

25 Claims, 7 Drawing Sheets

400

(56) References Cited

U.S. PATENT DOCUMENTS

2006/0092079 A1* 5/2006 de Rochemont ..... H01Q 1/362 343/700 MS
2008/0266018 A1* 10/2008 Han ..... H01P 1/2005 333/12
2008/0314630 A1* 12/2008 Kim ..... H01P 1/2005 174/261
2009/0308653 A1* 12/2009 Wu ..... H01Q 1/526 174/377
2010/0045536 A1* 2/2010 Fukui ..... H01Q 1/38 343/700 MS
2010/0053013 A1* 3/2010 Konishi ..... H01F 10/20 343/772
2010/0214178 A1* 8/2010 Toyao ..... H01P 1/2005 343/702
2010/0265159 A1* 10/2010 Ando ..... H01Q 9/0421 343/913
2010/0328178 A1* 12/2010 Cho ..... H01Q 1/2283 343/841
2011/0012697 A1* 1/2011 Takemura ..... H01P 1/2005 333/212
2011/0026234 A1* 2/2011 Kim ..... H05K 1/0236 361/800
2011/0134010 A1* 6/2011 Toyao ..... H01P 1/2005 343/844
2011/0299264 A1* 12/2011 Kim ..... H05K 1/0236 361/818
2012/0007786 A1* 1/2012 Ando ..... H01Q 9/0407 343/749
2012/0032865 A1* 2/2012 Toyao ..... H01P 1/2005 343/835
2012/0319908 A1* 12/2012 Tsutsumi ..... H01Q 1/243 343/702
2013/0176683 A1* 7/2013 Chao ..... H01L 23/3677 361/719

* cited by examiner

200

300

400

500

600

700

EBG DESIGNS FOR MITIGATING RADIO FREQUENCY INTERFERENCE

TECHNICAL FIELD

The present techniques generally relate to radio frequency interference. More specifically, the present techniques relate to preventing radio frequency interference within a chassis.

BACKGROUND ART

Computing platforms such as computing systems, tablets, laptops, mobile phones, and the like are housed within a chassis. As the size of these devices gets smaller, interference from various motherboard components and digital transmissions are in closer proximity to various wireless antennas of the device.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

Figure 1:
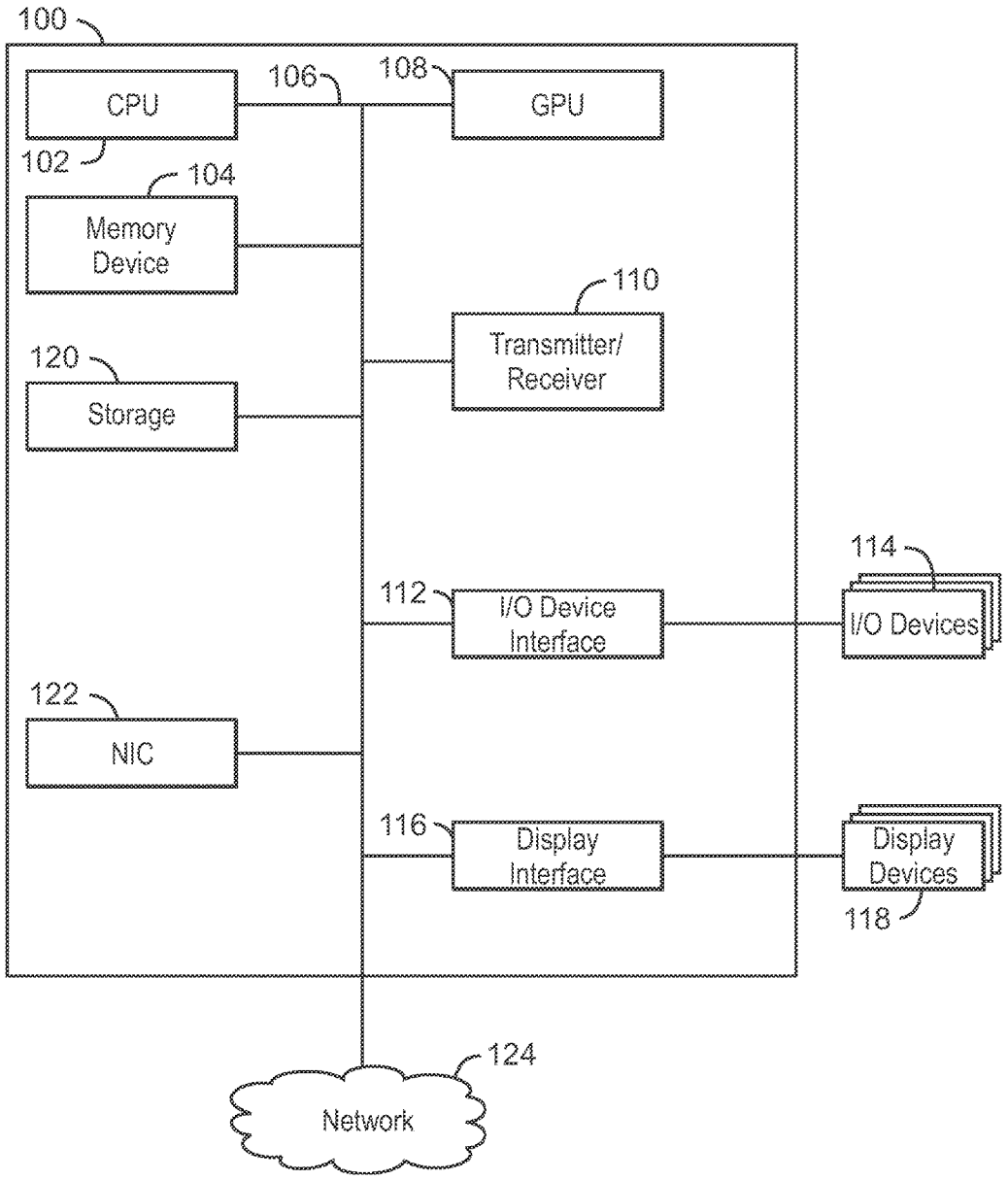
FIG. 1 is a block diagram of a computing device that may include structured stereo.

As noted above, smaller computing devices result in interference from a motherboard and the resulting digital transmissions being in closer proximity to wireless antennas of the device. The mobile computer industry has been evolving, in a fast pace to small computing devices such as ultrabook and tablet designs. Integrating wireless standards such as a those according to the WiFi Alliance (WiFi), networks that comply with the International Mobile Telecommunications-2000 (IMT-2000) specifications (3G), and Long Term Evolution (LTE) standards into compact ultrabook or tablet form factors can be challenging as electromagnetic noise generated from components such as the central processing unit (CPU), platform controller hub (PCH), double data rate (DDR) memory, panel timing controller, motherboard layout, and the like are now in much closer proximity to the antennas. Additionally, antennas may be placed within the same enclosure or chassis as the motherboard. Furthermore, the chassis is typically a metal enclosure, which in turn serves as a propagation path for the electromagnetic interference as opposed to a shield for the electromagnetic interference. This interference or noise received by the antenna can degrade wireless performance, such as throughput, and deteriorate user experience.

Embodiments described herein enable electromagnetic bandgap (EBG) designs for mitigating radio frequency interference, also known as electromagnetic interference (EMI). In an embodiment, an EBG structure is attached to the surface of an apparatus such that noise propagation is mitigated within a chassis. The EBG structure can be a mushroom type EBG structure, and the EBG structure can be integrated into the surface of the apparatus. Using the present techniques, electromagnetic interference can be mitigated without the addition of printed circuit board (PCB) layers used in typical electromagnetic interference shielding. The use of the EBG structure to mitigate electromagnetic interference can achieve global isolation where interference is mitigated throughout the entire chassis. The use of the EBG structure to mitigate electromagnetic interference can also achieve local isolation where interference is removed from a portion of the chassis, such as an area surrounding the antennas of the computing device. In some cases the EBG structure is integrated with or coupled to a portion of the chassis or a thermal device of the computing device. In this manner, the present techniques are a flexible design that can be applied to a number of chassis implementations.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

FIG. 1 is a block diagram of a computing device 100 that may include an EBG structure design. The computing device 100 may be, for example, a laptop computer, desktop computer, tablet computer, ultrabook, mobile device, or server, among others. The computing device 100 may include a central processing unit (CPU) 102 that is configured to execute stored instructions, as well as a memory device 104 that stores instructions that are executable by the CPU 102. The CPU may be coupled to the memory device 104 by a bus 106. Additionally, the CPU 102 can be a single core processor, a multi-core processor, a computing cluster, or any number of other configurations. Furthermore, the computing device 100 may include more than one CPU 102. The memory device 104 can include random access memory (RAM), read only memory (ROM), flash memory, or any other suitable memory systems. For example, the memory device 104 may include dynamic random access memory (DRAM).

The computing device 100 may also include a graphics processing unit (GPU) 108. As shown, the CPU 102 may be coupled through the bus 106 to the GPU 108. The GPU 108 may be configured to perform any number of graphics operations within the computing device 100. For example, the GPU 108 may be configured to render or manipulate graphics images, graphics frames, videos, or the like, to be displayed to a user of the computing device 100. The computing device may also include a transmitter/receiver 110. In some cases, the transmitter/receiver 110 is a transceiver. The transmitter/receiver 110 may include various antennas into order to transmit and receive wireless data. Electromagnetic interference from other components of the computing device 100 can corrupt signals transmitted or received by the transmitter/receiver 110. In some cases, electromagnetic interference created by the transmission of data across a motherboard of the computing device 100 results in a total loss of data at the transmitter/receiver 110. Further, the electromagnetic interference can be a result of digital data transmitted within the computing device 100. For example, digital signals transmitted across a microstrip routed along the PCB can contribute to the electromagnetic interference, as well as any integrated circuits and chipsets within the computing device 100. The present techniques can be used to mitigate the electromagnetic interference created by the motherboard, data transmission, integrated circuits and chipsets, thereby enabling the transmitter/receiver 110 to transmit or receive a clean signal.

The CPU 102 may be connected through the bus 106 to an input/output (I/O) device interface 112 configured to connect the computing device 100 to one or more I/O devices 114. The I/O devices 114 may include, for example, a keyboard and a pointing device, wherein the pointing device may include a touchpad or a touchscreen, among others. The I/O devices 112 may be built-in components of the computing device 100, or may be devices that are externally connected to the computing device 100.

The CPU 102 may also be linked through the bus 106 to a display interface 116 configured to connect the computing device 100 to display devices 118. The display devices 118 may include a display screen that is a built-in component of the computing device 100. The display devices 118 may also include a computer monitor, television, or projector, among others, that is externally connected to the computing device 100.

The computing device also includes a storage device 120. The storage device 120 is a physical memory such as a hard drive, an optical drive, a thumbdrive, an array of drives, or any combinations thereof. The storage device 120 may also include remote storage drives. The computing device 100 may also include a network interface controller (NIC) 122 that may be configured to connect the computing device 100 through the bus 106 to a network 124. The network 124 may be a wide area network (WAN), local area network (LAN), or the Internet, among others.

The block diagram of FIG. 1 is not intended to indicate that the computing device 100 is to include all of the components shown in FIG. 1. Further, the computing device 100 may include any number of additional components not shown in FIG. 1, depending on the details of the specific implementation.

In some cases, a chassis of the computing device 100 is a metal enclosure that serves as a propagation path for electromagnetic interference from components of the computing device on the antennas of the computing device 100 instead of a shield. As discussed above, the electromagnetic interference created within a platform of a computing device can corrupt a radio signal received at a receiver or transceiver of the computing device. Using the present techniques, the electromagnetic interference can be directed away from the antennas of the device, thereby shielding the antennas from the interference. In embodiments, the EBG structure and be integrated with or attached to the chassis of the computing device in order to mitigate the transmission of electromagnetic interference. The EBG structure can mitigate electromagnetic interference through an attachment or integration with a portion of the chassis. In examples, the EBG structure is attached to or integrated with one side of the chassis. Thus, the EBG structure does not need to extend throughout the entire chassis in order to mitigate electromagnetic interference.

Typically, the noise source on the motherboard is shielded using electromagnetic interference shielding cages mounted onto the PCB. However, electromagnetic interference shielding cages are a costly solution and can increase a Z-height of the motherboard. Thus, additional layers may be added to the PCB in order to accommodate the electromagnetic interference shielding cages. Moreover, the motherboard has to implement mounting pads on the surface layers of the PCB to accommodate the electromagnetic interference shielding cages, which limits the microstrip routing on the PCB. Accordingly, the circuit layout is limited on the PCB by the shielding cage. Moreover, a PCB with additional layers further increases the cost of the PCB. Using electromagnetic interference shielding cages can result in thermal design issues as well, since the cages can block the air flow for cooling and also make the conventional heat spreader/heat pipe difficult to be implemented in the device design. The EBG structures implemented as a portion of the chassis or thermal device do not block cooling of the device. Further, the EBG structures implemented as a portion of the chassis or thermal device do not result in additional layers of the PCB.

Figure 2:
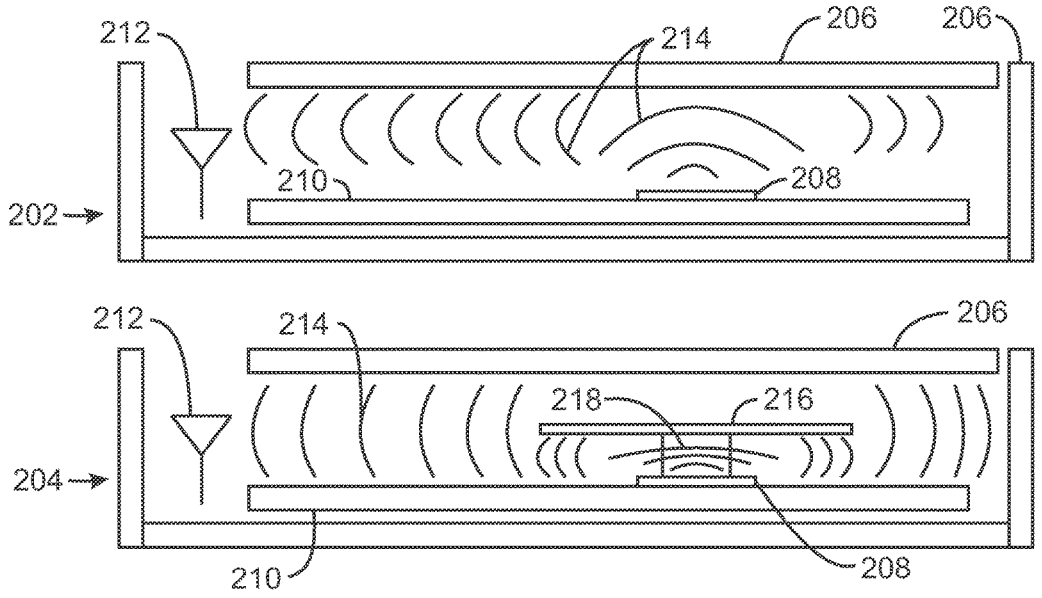
FIG. 2 illustrates two chassis designs with platform noise.

FIG. 2 illustrates two chassis designs with platform noise. FIG. 2 includes a design 202 and a design 204. The design 202 includes a chassis 206 with a noise producing component 208. In embodiments, the noise producing component is any component of a computing device that emits noise that can corrupt operation of the device according to a wireless standard. For example, the noise producing component 208 may be a CPU, PCH, memory device, panel timing controller, chipset, integrated circuit, and the like. The noise producing component may traces along the motherboard.

The noise producing component 208 is coupled with a printed circuit board (PCB) 210. The design 202 also includes an antenna 212. As illustrated in FIG. 2, noise, radio frequency interference, or electromagnetic interference 214 freely travels to the antenna 212 from the noise producing component 208. In some cases, the chassis 206 serves as a propagation path for the electromagnetic interference 214 to travel to the antenna 212, such that the chassis 206 guides the electromagnetic interference 214 to the antenna 212. The electromagnetic interference 214 can corrupt signals sent or received by the antenna 212.

Similarly, the design 204 includes a chassis 206 with a noise producing component 208 coupled with a PCB 210. However, a thermal device 216 is coupled with a thermal interface material 218 and the noise producing component 208. The thermal device 216 can be a heat sink, heat spreader, heat pipe, or the like. As illustrated, the thermal device 216 can guide the noise or electromagnetic interference 214. However, the electromagnetic interference still travels to the antenna 212, where it may corrupt a signal sent or received by the antenna 212.

The thermal device can be used with an electromagnetic bandgap (EBG) structure to prevent propagation of the noise or electromagnetic interference. The EBG structure may also be applied to the chassis of the computing device in order to prevent propagation of electromagnetic interference throughout the chassis of the computing device. In some cases, the EBG structure is designed as integrated into the chassis, prior to the manufacture of the chassis. In some cases, the EBG structure is applied to the chassis or heat spreader after the design and manufacture of the device. In embodiments, the EBG structure may be an adhesive tape which that transforms a conventional metal chassis to an EBG-type chassis using the present techniques.

Figure 3:
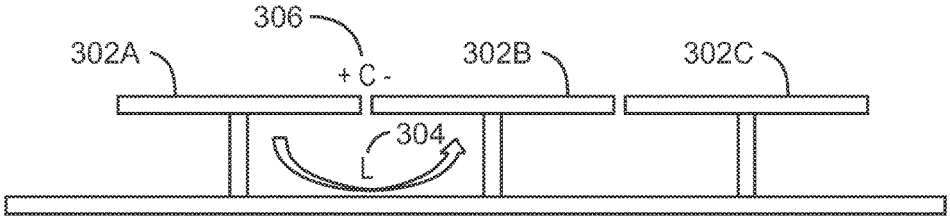
FIG. 3 is a mushroom type EBG structure.

FIG. 3 is a mushroom type EBG structure 300. The mushroom type EBG structure includes a plurality of mushrooms 302A, 302B, and 302C. The EBG structure can be a periodic mushroom EBG structure. In some cases, each mushroom EBG structure 302 includes a metal post with a metal top which resembles a "T" or a mushroom. The lower portion of the plurality of mushrooms may be a solid metal plane. The solid metal plane can be used to couple the plurality of mushroom type EBG surfaces with a surface of a chassis or thermal device, such as a heat sink, heat spreader, heat pipe, or the like. Such an EBG design can transform a low impedance surface into a high impedance surface for a selective frequency band. In some cases, the impedance initially observed within the chassis is a function of the inductance L at reference number 304 and the capacitance C at reference number 306. In examples, an increase in capacitance 306 or decrease in inductance 304 results in a decrease in impedance. Further, an increase in inductance 304 and a decrease in capacitance 306 may result in an increase in impedance. In some cases, the EBG structure increases the inductance observed by electromagnetic interference within a chassis such that the chassis includes a high impedance surface that mitigates the propagation of electromagnetic interference.

Although mushroom type EBG structures are described herein, any EBG structure can be used to mitigate the propagation of electromagnetic interference according to the present techniques. For example, the EBG structures may be a spiral EBG structure, wide band EBG structure, or a planar EBG structure. Further, several types of EBG structures can be combined in a single design to mitigate electromagnetic interference within a single chassis. Several types of EBG structures can be combined in a single design coupled with a thermal device in order to mitigate electromagnetic interference within a single chassis. Moreover, the present techniques include an EBG structure that can be applied to a chassis surface of any material. Accordingly, a chassis with a metal coating may be using according to the present techniques. Further, a chassis that includes a metal foil, such as an aluminum foil attached to an interior portion of the chassis. In embodiments, the metal coating or metal foil of the chassis can be positioned along with the EBG structure in order to direct any electromagnetic interference away from antennas within the chassis. Additionally, each of the exemplary WiFi, 3G, and LTE standards include wireless antennas that may operate at different frequencies. Accordingly, the EBG structure design can be modified to mitigate electromagnetic interference on each type of antenna, either alone or in any combination. For example, depending on the design of the EBG structure, the electromagnetic interference frequency band mitigated can be made large, small, or target a particular range depending on the EBG structure.

Figure 4:
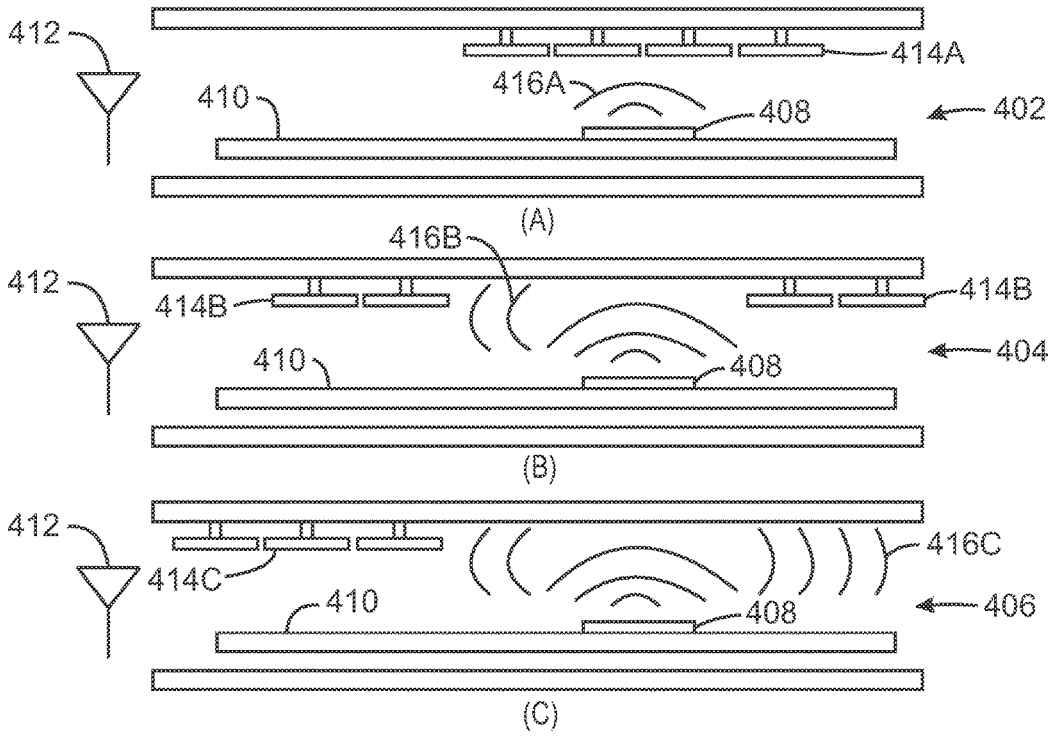
FIG. 4 is an illustration of several EBG structure designs.

FIG. 4 is an illustration of several EBG structure designs 400. The designs 400 include an EBG structure design 402, an EBG structure design 404, and an EBG structure design 406. The each design includes a noise producing component 408 attached to a printed circuit board (PCB) 410, and an antenna 412. The EBG structure design 402 illustrates an EBG structure 414A implemented above the noise producing component 408. Accordingly, the noise 416A is mitigated by the EBG structure 414A and prevented from traveling to the antenna 412. Similarly, the EBG structure design 404 illustrates an EBG structure 414B implemented above and to each side of the noise producing component 408. Accordingly, the noise 416B is mitigated by the EBG structure 414B and prevented from traveling to the antenna 412. The EBG structures 414A and 414B can be used to achieve global isolation that mitigates the electromagnetic interference throughout the chassis of the computing device. The EBG structures 414A and 414B are able to mitigate electromagnetic interference by attaching the EBG structures 414A and 414B to one side of the chassis. Moreover, the EBG structures 414A and 414B can be integrated with the chassis, or the EBG structures 414A and 414B can be applied to the chassis using an EBG adhesive tape as described in FIG. 6.

The EBG structure design 406 illustrates an EBG structure 414C implemented around the antenna 412. Accordingly, the noise 416C is mitigated by the EBG structure 414C and prevented from traveling to the antenna 412. In this manner, the surfaces of chassis become high impedance through the addition of the EBG surface. The design 406 implements the EBG structure 414C by surrounding the antenna 412 in the design 406. The EBG structure 414C can, therefore, provide local isolation to the antenna 412.

Figure 5:
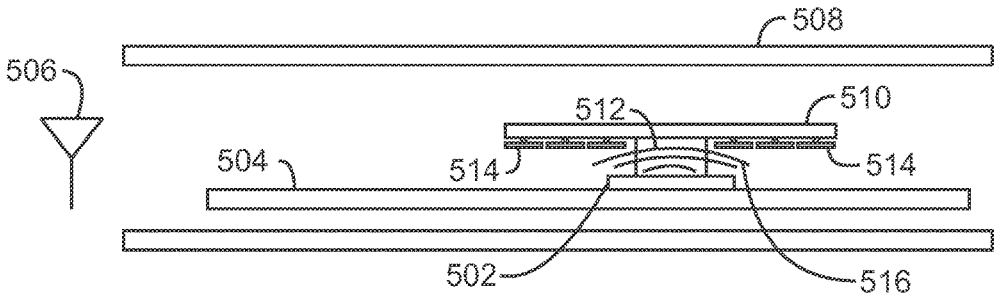
FIG. 5 is an EBG design under a thermal device.

FIG. 5 is an EBG design 500 under a thermal device. The design 500 includes a noise producing component 502 attached to a printed circuit board (PCB) 504, and an antenna 506. The EBG design 500 is implemented within a chassis 508. The EBG design 500 includes a thermal device. For exemplary purposes, the thermal device is a heat spreader 510, however any thermal device may be used. The heat spreader 510 is coupled with a thermal interface material 512. An EBG structure 514 is coupled with the heat spreader 510. The EBG structure may be integrated with the heat spreader 510, or the EBG structure can be applied to the heat spreader 510 using an EBG adhesive tape as described in FIG. 6. The EBG structure 514 is implemented above the noise producing component 502. The electromagnetic interference 516 is mitigated by the EBG structure 514 coupled with the heat spreader 510. The electromagnetic interference 516 is prevented from traveling to the antenna 506.

Accordingly, the EBG structure implementation is flexible. To prevent the noise from coupling to the antenna, the EBG can be implemented above the noise source, surrounding the noise source, or surrounding the antenna. The EBG design according to present techniques can be thin and light compared to shielding cages. In some cases, the EBG design neither blocks air flow nor impacts thermal design of the computing device. Further, the EBG structure does not require a connection between top and bottom portions of the chassis. As described above, the EBG structure can be implemented directly through an industrial design. For example, the EBG structure can be implemented when the chassis is designed. Also, an EBG adhesive tape can be used to retrofit an existing chassis with an EBG design in order to mitigate electromagnetic interference. The EBG adhesive tape can be implemented after the design of the chassis in order to mitigate electromagnetic interference.

Figure 6:
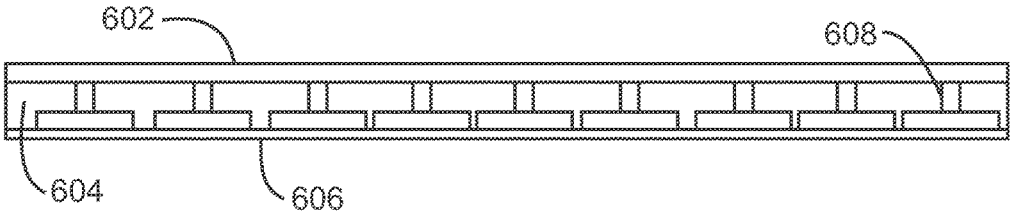
FIG. 6 is an EBG adhesive tape.

FIG. 6 is an EBG adhesive tape 600. The tape 600 can be attached to a chassis surface or heat spreader in order to make the surface high impedance and mitigate electromagnetic interference. The tape 600 includes a conductive adhesive layer 602. An insulation layer 604 is coupled with the conductive adhesive layer 602 and includes a plurality of EBG structures 608. The tape 600 can be applied to any surface using the conductive adhesive layer 602. In this manner, any surface within a chassis can be transformed to a high impedance structure in order to mitigate the propagation of electromagnetic interference throughout the chassis. Accordingly, the entire chassis may be converted to a high impedance EBG structure through the use of the tape 600. In examples, the tape 600 is applied to a single side of the chassis. In other examples, the tape 600 is applied to a thermal device.

Figure 7:
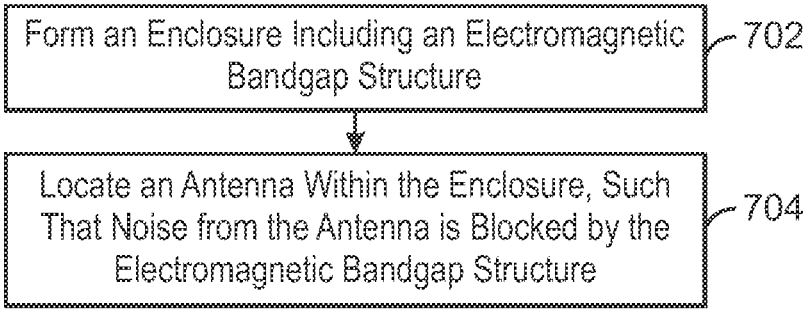
FIG. 7 is a process flow diagram for constructing an electronic device with electromagnetic interference shielding.

FIG. 7 is a process flow diagram 700 for constructing an electronic device with electromagnetic interference shielding. At block 702, an enclosure including an electromagnetic bandgap (EBG) structure is formed. In some cases, the enclosure is a chassis that includes an EBG structure as part of the industrial design of the chassis. Additionally, in some cases, the EBG structure is applied to the chassis as an EBG adhesive tape after the design of the chassis. At block 704, an antenna is located within the structure, such that the noise from the antenna is blocked by the EBG structure. Accordingly, the antenna may be located in a position within the chassis wherein the electromagnetic interference from the digital communications within the chassis is mitigated. As a result, EBG structures as described herein can be used to stop noise propagation. When the noise propagates through the chassis, the noise is reflected by the EBG structure surrounding the antenna. In this manner, the antenna receives less noise when compared to a chassis without EBG structures.

Example 1

An apparatus for electromagnetic interference shielding is described herein. The apparatus includes an electromagnetic bandgap (EBG) structure. The EBG structure is attached to a surface of the apparatus such that the EBG structure is to mitigate electromagnetic interference propagation within the apparatus.

The apparatus may be a chassis of an electronic device, and the EBG structure may be attached to one surface of the chassis. The apparatus may be a heat sink, and the EBG structure may be attached to one surface of the heat sink, or the apparatus may be a heat pipe, and the EBG structure may be attached to one surface of the heat pipe. Additionally, the apparatus may be a heat spreader, and the EBG structure may be attached to one surface of the heat spreader. The EBG structure may be adjusted to block a frequency band electromagnetic interference, such that a selective frequency of electromagnetic interference may be mitigated. The EBG structure may be a mushroom type EBG structure. Further, the EBG structure may be integrated into the surface of the apparatus. The EBG structure may also be attached to the surface of the apparatus using an adhesive. The EBG structure is to mitigate electromagnetic interference without impacting a thermal design of the apparatus.

Example 2

A method for constructing an electronic device with electromagnetic interference shielding is described herein. The method includes forming an enclosure of the electronic device, where the enclosure includes an electromagnetic bandgap (EBG) structure. The method also includes locating an antenna and a plurality of noise producing components within the enclosure to block noise from the plurality of noise producing components from the antenna.

The EBG structure may be a mushroom type EBG structure, or the EBG structure may be integrated with the enclosure. An arrangement of the EBG structure on the enclosure may be generated during an industrial design of the enclosure. The noise producing components include at least a central processing unit (CPU), platform controller hub (PCH), memory device, panel timing controller, motherboard layout, or any combination thereof. The EBG structure may be selected to mitigate a frequency band of the electromagnetic interference to block a selective frequency of the electromagnetic interference. The enclosure may include a metallic coating that directs the electromagnetic interference away from the antenna. Additionally, the metallic coating may direct the electromagnetic interference from the noise producing components throughout the entire chassis. The enclosure may be an electromagnetic interference metal enclosure. Further, the antenna can transmit signals such as Wifi, 3G, LTE, or any combination thereof.

Example 3

A method for fitting an electronic device for electromagnetic interference shielding is described herein. The method includes attaching an electromagnetic bandgap (EBG) adhesive tape to a surface within the electronic device to prevent noise from interfering with the operation of an antenna.

The surface may be a housing of the electronic device. The EBG adhesive tape may include a conductive adhesive layer. The EBG adhesive tape may include a mushroom type EBG structure. The surface may be a portion of a housing of the electronic device. Further, the surface may be a heat sink, and the EBG adhesive tape may be attached to one surface of the heat sink, or the surface may be a heat pipe, and the EBG adhesive tape may be attached to one surface of the heat pipe. The surface may also be a heat spreader, and the EBG adhesive tape may be attached to one surface of the heat spreader. The EBG adhesive tape may include an EBG structure that is selected to mitigate a portion of the noise, such that a selective frequency of the noise may be blocked. The EBG adhesive tape can mitigate noise propagation without impacting a thermal design of the electronic device.

Example 4

An apparatus for electromagnetic interference shielding is described herein. The apparatus includes a means for suppressing noise. The means for suppressing noise is attached to a surface of the apparatus such that the means for suppressing noise is to mitigate noise propagation.

The apparatus may be a chassis of an electronic device, and the means for suppressing noise may be attached to one surface of the chassis. The apparatus may be a heat sink, and the means for suppressing noise may be attached to one surface of the heat sink, or the apparatus may be a heat pipe, and the means for suppressing noise may be attached to one surface of the heat pipe. The apparatus may also be a heat spreader, and the means for suppressing noise may be attached to one surface of the heat spreader. The means for suppressing noise may be designed to block a frequency band of electromagnetic interference, such that a selective frequency of electromagnetic interference may be mitigated. Further, the means for suppressing noise may be a mushroom type EBG structure. The means for suppressing noise may also be integrated into the surface of the apparatus. Additionally, the means for suppressing noise may be attached to the surface of the apparatus using an adhesive. The means for suppressing noise can mitigate electromagnetic interference without impacting a thermal design of the apparatus.

It is to be understood that specifics in the aforementioned examples may be used anywhere in one or more embodiments. For instance, all optional features of the computing device described above may also be implemented with respect to either of the methods described herein or a computer-readable medium. Furthermore, although flow diagrams and/or state diagrams may have been used herein to describe embodiments, the present techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An apparatus for electromagnetic interference shielding, comprising:

an electromagnetic bandgap (EBG) structure;

a surface of the apparatus, wherein the EBG structure is disposed onto the surface and in between an interference generating source and an antenna, wherein the EBG structure is to provide isolation to the antenna from an electromagnetic interference band comprising an operating frequency of the antenna generated by the interference generating source coupled to an opposing surface of a printed circuit board from the surface of the apparatus, the apparatus comprising a chassis enclosing the printed circuit board, the antenna, and the interference generating source, wherein the printed circuit board, the antenna, and the interference generating source are attached to the chassis, wherein the chassis comprises a metal enclosure that serves as a propagation path for the electromagnetic interference band from the interference generating source and the EBG structure prevents propagation of the electromagnetic interference band to the antenna.

2. The apparatus of claim 1, wherein the EBG structure is integrated into one surface of the chassis.

3. The apparatus of claim 1, comprising a heat sink, wherein a second EBG structure integrated into to one surface of the heat sink.

4. The apparatus of claim 1, comprising a heat pipe, wherein a second EBG structure is integrated into one surface of the heat pipe.

5. The apparatus of claim 1, comprising a heat spreader, wherein a second EBG structure is integrated into one surface of the heat spreader.

6. The apparatus of claim 1, wherein the EBG structure is a mushroom type EBG structure.

7. The apparatus of claim 1, wherein a second EBG structure is attached to the surface of the apparatus using an adhesive such that the second EBG structure is an EBG adhesive tape.

8. The apparatus of claim 1, wherein the EBG structure comprises a combined plurality of types of EBG structures, wherein the plurality of types of EBG structures comprises a spiral EBG structure, a wide band EBG structure, a planar EBG structure, or any combination thereof.

9. The apparatus of claim 1, wherein a metal coating or a metal foil of the chassis can be positioned along with the EBG structure in order to direct any electromagnetic interference away from antennas within the chassis.

10. A method for constructing an electronic device with electromagnetic interference shielding, comprising:

forming an enclosure of the electronic device, where an electromagnetic bandgap (EBG) structure is disposed onto an inner surface of the enclosure;

locating an antenna and a plurality of interference generating sources within the enclosure to block noise from the plurality of interference generating sources from the antenna, wherein the EBG structure is implemented in between the interference generating sources and the antenna to provide isolation to the antenna from an electromagnetic interference band comprising an operating frequency of the antenna generated by a component of the plurality of interference generating sources coupled to an opposing surface of a printed circuit board from the surface of the apparatus, the enclosure comprising a chassis enclosing the printed circuit board, the antenna, and the interference generating source, wherein the printed circuit board, the antenna, and the interference generating source are attached to the chassis, wherein the chassis comprises a metal enclosure that serves as a propagation path for the electromagnetic interference band from the interference generating source and the EBG structure prevents propagation of the electromagnetic interference band to the antenna.

11. The method of claim 10, wherein the EBG structure is a mushroom type EBG structure.

12. The method of claim 10, wherein EBG structure is integrated with the enclosure.

13. The method of claim 10, wherein an arrangement of the EBG structure on the enclosure is generated during an industrial design of the enclosure.

14. The method of claim 10, wherein the interference generating sources include at least a central processing unit (CPU), platform controller hub (PCH), memory device, panel timing controller, motherboard layout, or any combination thereof.

15. The method of claim 10, wherein the EBG structure is selected to mitigate a frequency band of the electromagnetic interference, to block a selective frequency of the electromagnetic interference.

16. The method of claim 10, wherein the enclosure includes a metallic coating that directs the electromagnetic interference away from the antenna.

17. The method of claim 10, wherein a metallic coating directs the electromagnetic interference from the interference generating sources throughout the enclosure.

18. A method for fitting an electronic device for electromagnetic interference shielding, comprising:

attaching an electromagnetic bandgap (EBG) adhesive tape comprising an electromagnetic bandgap (EBG) structure to a surface in between an antenna and an interference generating source within the electronic device to prevent noise generated by the interference generating source from interfering with the operation of the antenna, wherein the EBG structure is to mitigate an electromagnetic interference band comprising an operating frequency of the antenna, and wherein the interference generating source is coupled to an opposing surface of a printed circuit board from the surface of a chassis of the electronic device, the chassis enclosing the printed circuit board, the antenna, and the interference generating source, wherein the printed circuit board the antenna, and the interference generating source are attached to the chassis, wherein the chassis comprises a metal enclosure that serves as a propagation path for the electromagnetic interference band from the interference generating source and the EBG structure prevents propagation of the electromagnetic interference band to the antenna.

19. The method of claim 18, wherein the surface is a housing of the electronic device.

20. The method of claim 18, wherein the EBG adhesive tape includes a conductive adhesive layer.

21. The method of claim 18, wherein the EBG adhesive tape includes a mushroom type EBG structure.

22. The method of claim 18, wherein the surface is a portion of a housing of the electronic device.

23. The method of claim 18, wherein the surface is a heat sink, and the EBG adhesive tape is attached to one surface of the heat sink.

24. The method of claim 18, wherein the surface is a heat pipe, and the EBG adhesive tape is attached to one surface of the heat pipe.

25. The method of claim 18, wherein the surface is a heat spreader, and the EBG adhesive tape is attached to one surface of the heat spreader.

* * * * *